US012715648B2

(12) United States Patent
Holstine et al.

(10) Patent No.: US 12,715,648 B2
(45) Date of Patent: Aug. 25, 2026

(54) THIN-WALLED METAL CUP

(71) Applicant: Silgan Containers LLC, Woodland Hills, CA (US)

(72) Inventors: Rowdy Holstine, Hartford, WI (US); Bambi Biedenbender, Waukesha, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 469 days.

(21) Appl. No.: 17/889,027

(22) Filed: Aug. 16, 2022

(65) Prior Publication Data

US 2023/0047517 A1 Feb. 16, 2023

Related U.S. Application Data

(63) Continuation of application No. PCT/US2022/039811, filed on Aug. 9, 2022.

(60) Provisional application No. 63/231,490, filed on Aug. 10, 2021.

(51) Int. Cl.

| | |
|---|---|
| ***B65D 8/00*** | (2006.01) |
| ***A47G 19/22*** | (2006.01) |
| ***B65D 6/00*** | (2006.01) |

(52) U.S. Cl.

CPC ..... *B65D 7/04* (2013.01); *A47G 19/2205* (2013.01); *B65D 7/12* (2013.01)

(58) Field of Classification Search

CPC . B65D 7/04; B65D 7/045; B65D 7/42; B65D 7/44; B65D 7/46; A47G 19/23

USPC ..... 220/592.17, 669, 670, 673, 674

See application file for complete search history.

(56) References Cited

U.S. PATENT DOCUMENTS

| | | | |
|---|---|---|---|
| 2,288,602 | A | 7/1942 | Benton |
| 2,808,168 | A | 10/1957 | Majer |
| 3,342,370 | A | 9/1967 | Johnson |
| 3,375,954 | A | 4/1968 | Arvid et al. |
| D213,173 | S | 1/1969 | Lockhart et al. |
| 4,049,122 | A | 9/1977 | Maxwell |
| 4,051,707 | A | 10/1977 | Valek et al. |
| 4,263,800 | A | 4/1981 | Arfert et al. |
| 4,483,171 | A | 11/1984 | Franek et al. |
| 4,503,702 | A | 3/1985 | Bulso, Jr. et al. |
| 4,782,685 | A | 11/1988 | Buldo, Jr. et al. |

(Continued)

FOREIGN PATENT DOCUMENTS

| | | |
|---|---|---|
| AU | 202210141 | 1/2022 |
| CA | 1185544 | 4/1985 |

(Continued)

OTHER PUBLICATIONS

International Search Report and Written Opinion for International Application No. PCT/US2022/039811, dated Nov. 23, 2022, 12 pages.

*Primary Examiner* — Robert Poon

(74) *Attorney, Agent, or Firm* — Reinhart Boerner Van Deuren s.c.

(57) ABSTRACT

Various embodiments of a thin-walled metal container, such as a cup are described. The thin-walled metal cup includes a body with a tightly curled lip at the top end of the cup. The body includes a plurality of sections such that the diameter of the cup may be different at different places along the height of the cup. The thin-walled metal cup is designed to be light weight with a shape configured to facilitate grasping or holding the body of the cup.

14 Claims, 7 Drawing Sheets

(56) References Cited

U.S. PATENT DOCUMENTS

| | | | | |
|---|---|---|---|---|
| 4,914,937 | A | 4/1990 | Bulso, Jr. et al. | |
| 4,967,538 | A | 11/1990 | Leftault, Jr. et al. | |
| 5,626,049 | A | 5/1997 | Saunders | |
| 6,038,910 | A | 3/2000 | McClung | |
| D531,854 | S | 11/2006 | Bresler | |
| D533,748 | S | 12/2006 | Bresler | |
| D537,677 | S | 3/2007 | Bresler | |
| D570,159 | S | 6/2008 | McGill | |
| 7,934,410 | B2 | 5/2011 | Myers et al. | |
| 7,954,354 | B2 | 6/2011 | Myers et al. | |
| 8,555,692 | B2 | 10/2013 | Myers et al. | |
| D717,605 | S | 11/2014 | Kristinik | |
| D717,606 | S | 11/2014 | Kristinik | |
| 8,944,045 | B2 | 2/2015 | Canela Mercade | |
| D732,343 | S | 6/2015 | Romley | |
| D747,925 | S | 1/2016 | Engler et al. | |
| 9,360,233 | B2 | 6/2016 | Baker et al. | |
| 9,499,327 | B2 * | 11/2016 | D'Amato | B65D 3/22 |
| 9,700,929 | B2 | 7/2017 | Fedusa et al. | |
| D797,512 | S | 9/2017 | O'Connor | |
| D903,424 | S | 12/2020 | Scott | |
| D906,056 | S | 12/2020 | Scott | |
| 10,875,076 | B2 | 12/2020 | Scott | |
| 2005/0061821 | A1 | 3/2005 | Smith et al. | |
| 2005/0189361 | A1 | 9/2005 | Bresler | |
| 2006/0277957 | A1 | 12/2006 | Fujishige et al. | |
| 2007/0295051 | A1 | 12/2007 | Myers et al. | |
| 2011/0226787 | A1 * | 9/2011 | Yourist | B65D 15/18 220/669 |
| 2012/0181205 | A1 * | 7/2012 | Alvares | B65D 21/022 206/519 |
| 2012/0193367 | A1 | 8/2012 | Baker et al. | |
| 2013/0291612 | A1 | 11/2013 | Dick et al. | |
| 2018/0221936 | A1 * | 8/2018 | Scott | B21D 51/10 |
| 2019/0112100 | A1 | 4/2019 | Scott | |
| 2020/0108433 | A1 | 4/2020 | Scott | |

FOREIGN PATENT DOCUMENTS

| | | |
|---|---|---|
| CH | 145594 | 11/2020 |
| CN | 104939489 | 9/2015 |
| CN | 112264548 | 1/2021 |
| CN | 202030657074.9 | 5/2021 |
| CN | 202130841855.8 | 6/2022 |
| EM | 008203194-0001 | 1/2021 |
| EM | 008827489-0001 | 1/2022 |
| GB | 673137 | 6/1952 |
| GB | 6109969 | 12/2020 |
| GB | 6186004 | 1/2022 |
| JP | 4761786 | 8/2011 |
| KR | 2002-0082183 | 10/2002 |
| NO | 086826 | 1/2021 |
| RU | 127231 | 8/2021 |
| SG | 30202008675 Y | 12/2020 |
| WO | WO2018147916 | 8/2018 |
| WO | WO2020/131922 | 6/2020 |
| WO | WO2020123291 | 6/2020 |

* cited by examiner

THIN-WALLED METAL CUP

CROSS-REFERENCE TO RELATED PATENT APPLICATIONS

The present application is a continuation of International Application No. PCT/US2022/039811, filed Aug. 9, 2022, which claims the benefit of and priority to U.S. Provisional Application No. 63/231,490, filed on Aug. 10, 2021, which are incorporated herein by reference in their entireties.

BACKGROUND OF THE INVENTION

The present invention relates generally to the field of metal containers. The present invention relates specifically to a thin-walled metal cup.

SUMMARY OF THE INVENTION

One embodiment of the invention relates to a thin-walled metal cup. The cup includes a first end and a second end opposing the first end. The cup further includes a circular lip extending between an outside edge and an inside edge centered on a longitudinal, central axis. The outside edge of the lip defines a first diameter. A cylindrical wall extends between the first end and second end of the cup and is centered on the longitudinal, central axis. The cylindrical wall includes an exterior surface, an interior surface where the interior surface defines a second diameter at the first end of the cup and a plurality of sections. The plurality of sections extend between the first end and second end of the cup and are connected by a plurality of curved transition portions. The cup further includes a bottom with a circular surface generally parallel to the lip and centered on the longitudinal axis. The circular surface connects to a trough at an outside edge of circular surface. The cup includes a height defined between a top of the lip and a lower edge of the trough.

Another embodiment of the invention relates to a thin-walled metal cup. The cup includes an open end including a central bore and a closed end opposing the open end of the up. The cup further includes a circular lip extending between an outside edge and an inside edge centered on a longitudinal, central axis. The outside edge of the lip defines a first diameter. A cylindrical wall extends between the open end and closed end of the cup and is centered on the longitudinal, central axis. The cylindrical wall includes an exterior surface, an interior surface and a plurality of sections connected by a plurality of curved transition portions. The cup further includes a bottom with a circular surface generally parallel to the lip and centered on the longitudinal axis. The circular surface connects to a trough at an outside edge of circular surface. The bore of the cup defines a second diameter at the open end of the cup. The cup includes a height defined between a top of the lip and a lower edge of the trough.

Another embodiment of the invention relates to a thin-walled metal cup. The cup includes an open end including a central bore and a closed end opposing the open end of the up. The cup further includes a circular lip extending between an outside edge and an inside edge centered on a longitudinal, central axis. The outside edge of the lip defines a first diameter. A cylindrical wall extends between the open end and closed end of the cup and is centered on the longitudinal, central axis. The cylindrical wall includes an exterior surface, an interior surface and a plurality of sections connected by a plurality of curved transition portions. The cup further includes a bottom with a circular surface generally parallel to the lip and centered on the longitudinal axis. The circular surface connects to a trough at an outside edge of circular surface. The cup further includes a cover couplable to the lip, the cover forming a tight seal that seals contents stored within the thin-walled metal cup. The bore of the cup defines a second diameter at the open end of the cup. The cup includes a height defined between a top of the lip and a lower edge of the trough. In a specific embodiment, the cup includes a height defined by the distance between a top of the lip and a lower edge of the trough.

Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a thin-walled metal container, such as a thin-walled metal cup, are shown. As discussed herein, Applicant has developed a number of improvements to the body or cylindrical wall of the cup. In one embodiment, the thin-walled metal cup includes a wall thickness that is relatively small compared to the height of the cup. The relatively thin walls allow for an overall smaller weight of the cup. The thin-walled metal cup includes a shape defined by a greater diameter at a top end adjacent to the opening of the cup than a diameter at the bottom end that opposes the top end. The generally tapered shape of the cup allows for improved grasping for users.

Figure 1:
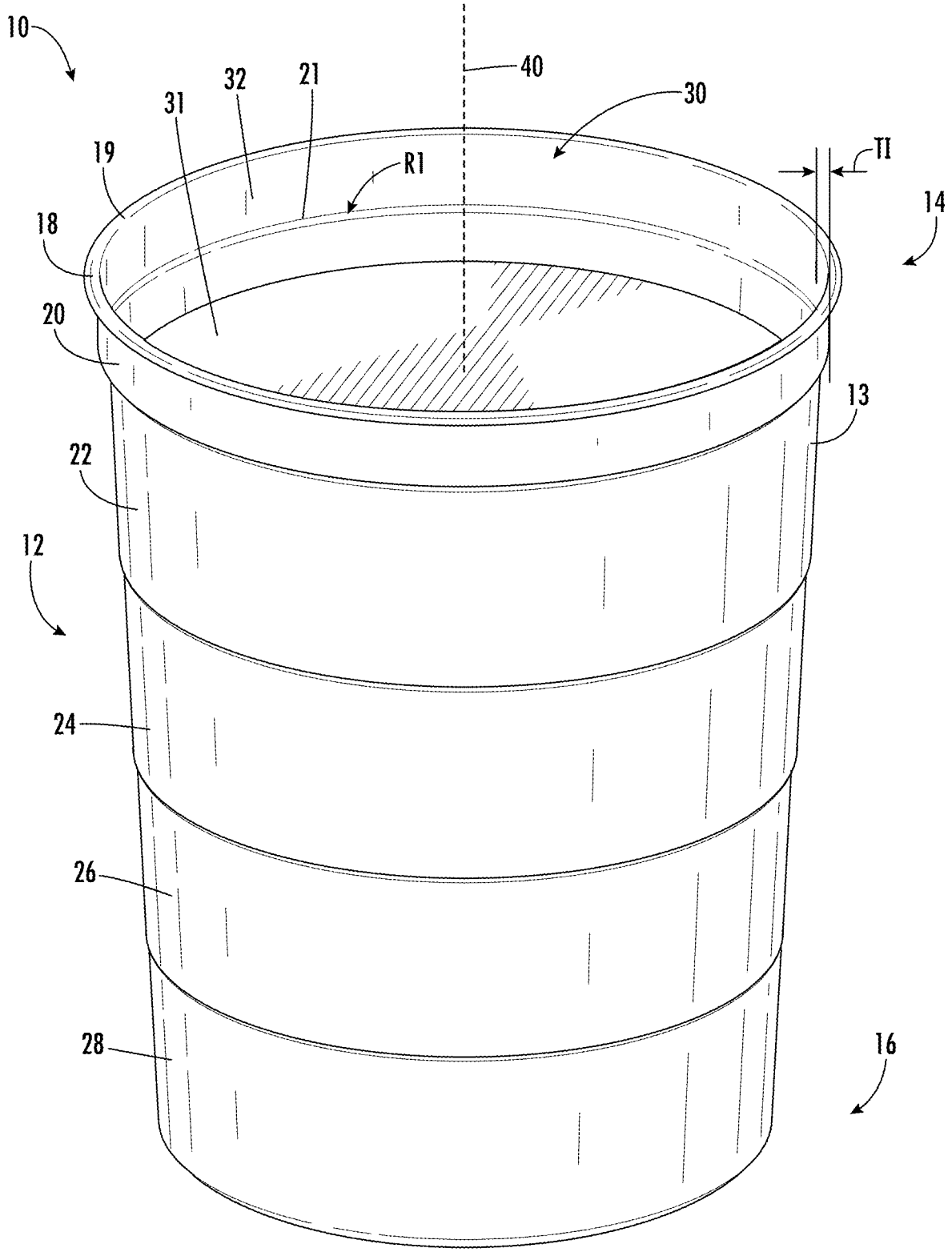
FIG. 1 is a front perspective view of a thin-walled metal cup, according to an exemplary embodiment.

Referring to FIG. 1, a thin-walled metal container, shown as a thin-walled metal cup 10, is shown according to an exemplary embodiment. Thin-walled metal cup 10 includes a body or cylindrical wall 12 coupled to a rim or lip 18. Cylindrical wall 12 extends along and is centered on a longitudinal axis, shown as a central axis 40 between a top end or first end 14 and a bottom or second end 16. The top end or first end 14 is positioned adjacent to lip 18 and the bottom or second end 16 opposes the top end 14. Top end 14 of cylindrical wall 12 includes a bore 30 centered around longitudinal, central axis 40. Cylindrical wall 12 includes an exterior surface 13 and an interior surface 32. An inner edge 19 of lip 18 at least partially defines bore 30. Bore 30 extends along and is centered on longitudinal, central axis 40 between top end 14 and bottom end 16.

Cylindrical wall 12 further includes a plurality of sections including a first portion or section 20, a second portion or section 22, a third portion or section 24, a fourth portion or section 26 and a fifth portion or section 28. First portion 20 extends generally downward away from lip 18 and is positioned between lip 18 and second portion 22. Second portion 22 extends generally downward away from first portion 20 and is positioned between first portion 20 and third portion 24. Third portion 24 extends generally downward away from second portion 22 and is positioned between second portion 22 and is positioned between second portion 22 and fourth portion 26. Fourth portion 26 extends generally downward away from third portion 24 and is positioned between third portion 24 and fifth portion 28. Fifth portion 28 extends generally downward away from fourth portion 26 and is positioned between fourth portion 26 and a bottom edge 34 (see e.g., FIG. 2) of cylindrical wall 12.

A first thickness, shown as T1 is defined between exterior surface 13 and interior surface 32 at first portion 20. In a specific embodiment, T1 is between 0.02 and 0.03 inches and in such embodiments is about 0.0231±0.01 inches. An internal curved surface 21 connects first portion 20 to second portion 22 along interior surface 32. Internal curved surface 21 has a radius shown as R1. In a specific embodiment, R1 is between 0.1 and 0.2 inches and in such an embodiment R1 is about 0.112±0.01 inches.

Figure 2:
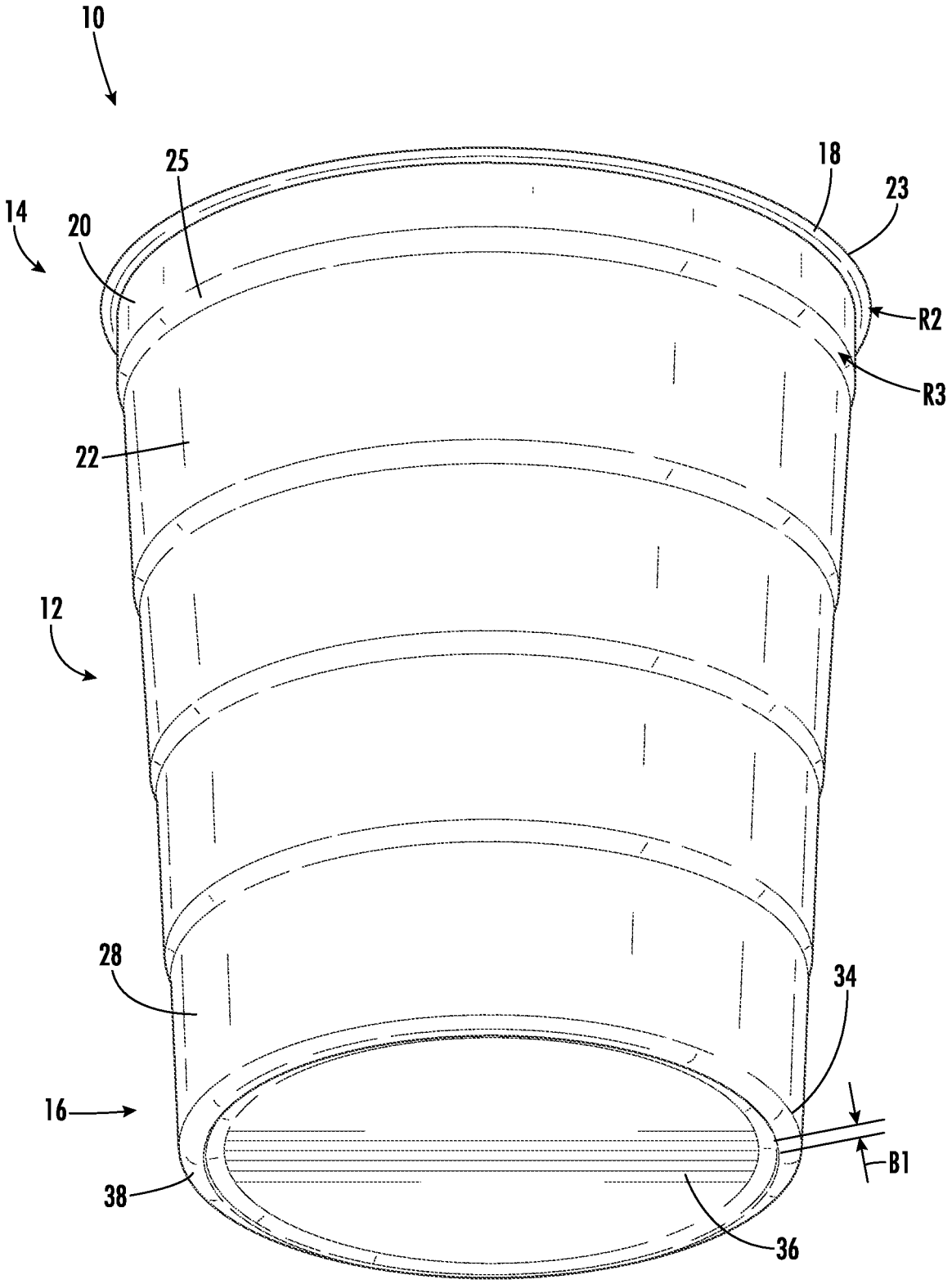
FIG. 2 is a rear perspective view of the thin-walled metal cup of FIG. 1, according to an exemplary embodiment.

Referring to FIG. 2, lip 18 includes an outer curved surface 23. Outer curved surface 23 defines a second radius shown as R2. In a specific embodiment, R2 is between 0.03 and 0.04 inches and in such embodiments is about 0.039±0.01 inches. An external curved surface 25 connects first portion 20 to second portion 22 along exterior surface 13. External curved surface 25 defines a third radius shown as R3. In a specific embodiment, R3 is between 0.1 and 0.2 inches and in such an embodiment R3 is about 0.113±0.01 inches.

Cylindrical wall 12 further includes an exterior bottom surface 36 oriented in a generally perpendicular manner relative to longitudinal, central axis 40. Exterior bottom surface 36 is connected to bottom edge 34 by a trough or bottom rim 38. Trough or bottom rim 38 includes a depth, shown as B1. In a specific embodiment, B1 is between 0.055 and 0.065 inches and in such an embodiment is about 0.06 inches±0.01 inches.

Figure 3:
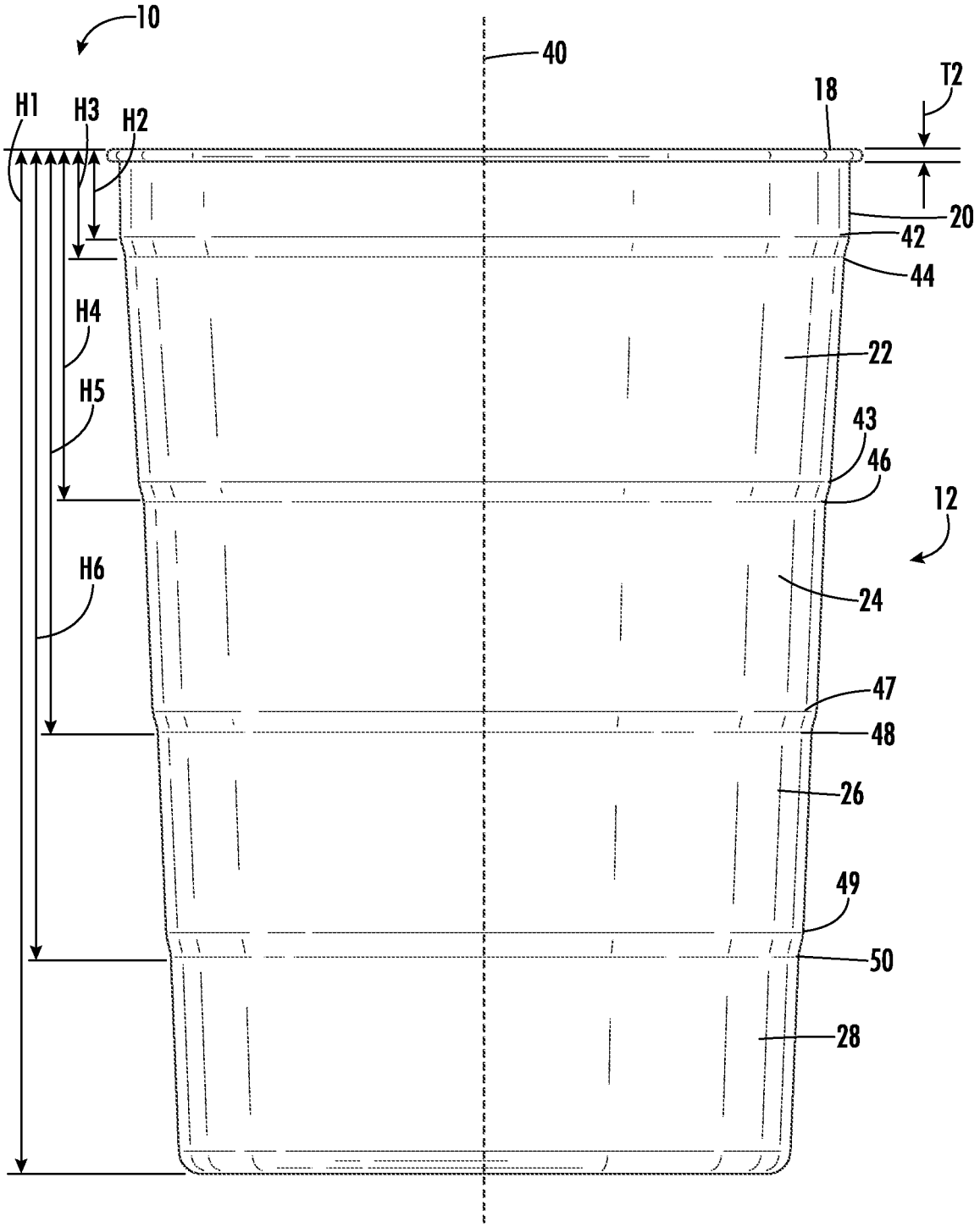
FIG. 3 is a front view of the thin-walled metal cup of FIG. 1, according to an exemplary embodiment.

Referring to FIG. 3, lip 18 is tightly curved and includes a thickness, shown as T2. In a specific embodiment, T2 is between 0.065 and 0.075 inches and in such an embodiment is about 0.07 inches±0.01 inches. A total height of thin-walled cup 10, shown as H1 is defined between a top of lip 18 and a bottom of trough 38. In a specific embodiment, H1 is between 4.25 and 4.75 inches and in such an embodiment is about 4.512 inches±0.02 inches. A second height, shown as H2 is defined between lip 18 and a lower boundary 42 of first portion 20. In a specific embodiment, H2 is between 0.3 and 0.4 inches and in such an embodiment H2 is about 0.378±0.01 inches. A third height, shown as H3 is defined between lip 18 and an upper boundary 44 of second portion 22. In a specific embodiment, H3 is between 0.4 and 0.5 inches and in such an embodiment H3 is about 0.489 inches±0.01 inches. A fourth height, shown as H4 is defined between lip 18 and an upper boundary 46 of third portion 24. In a specific embodiment, H4 is between 1.5 and 1.6 inches and in such an embodiment H4 is about 1.57 inches±0.01 inches. A fifth height shown as H5 is defined between lip 18 and an upper boundary 48 of fourth portion 26. In a specific embodiment, H5 is between 2.5 and 2.6 inches and in such an embodiment H5 is 2.577 inches±0.01 inches. A sixth height, shown as H6 is defined between lip 18 and an upper boundary 50 of fifth portion 28. In a specific embodiment H6 is between 3.5 and 3.6 inches and in such an embodiment H6 is about 3.56 inches±0.01 inches.

In a specific embodiment, H2 is between 5% and 15% of H1, specifically between 5% and 10% and more specifically between 7% and 9% of H1. In a specific embodiment, H3 is between 5% and 15% of H1, specifically between 7% and 12% of H1 and more specifically between 9% and 11% of H1. In a specific embodiment, H4 is between 25% and 40% of H1, specifically between 30% and 40% of H1 and more specifically between 32% and 35% of H1. In a specific embodiment, H5 is between 50% and 65% of H1, specifically between 50% and 60% of H1 and more specifically between 55% and 58% of H1. In a specific embodiment, H6 is between 70% and 85% of H1, specifically between 70% and 80% of H1 and more specifically between 77% and 80% of H1.

In one embodiment, thin-walled metal cup 10 is designed to hold 16.59 fluid ounces. In such an embodiment, T1 is between 0.1% and 10% of H1, specifically between 0.1% and 5% of H1 and specifically between 0.1 and 1% of H1. In such an embodiment, T1 is 0.0231 inches±0.01 inches.

Figure 4:
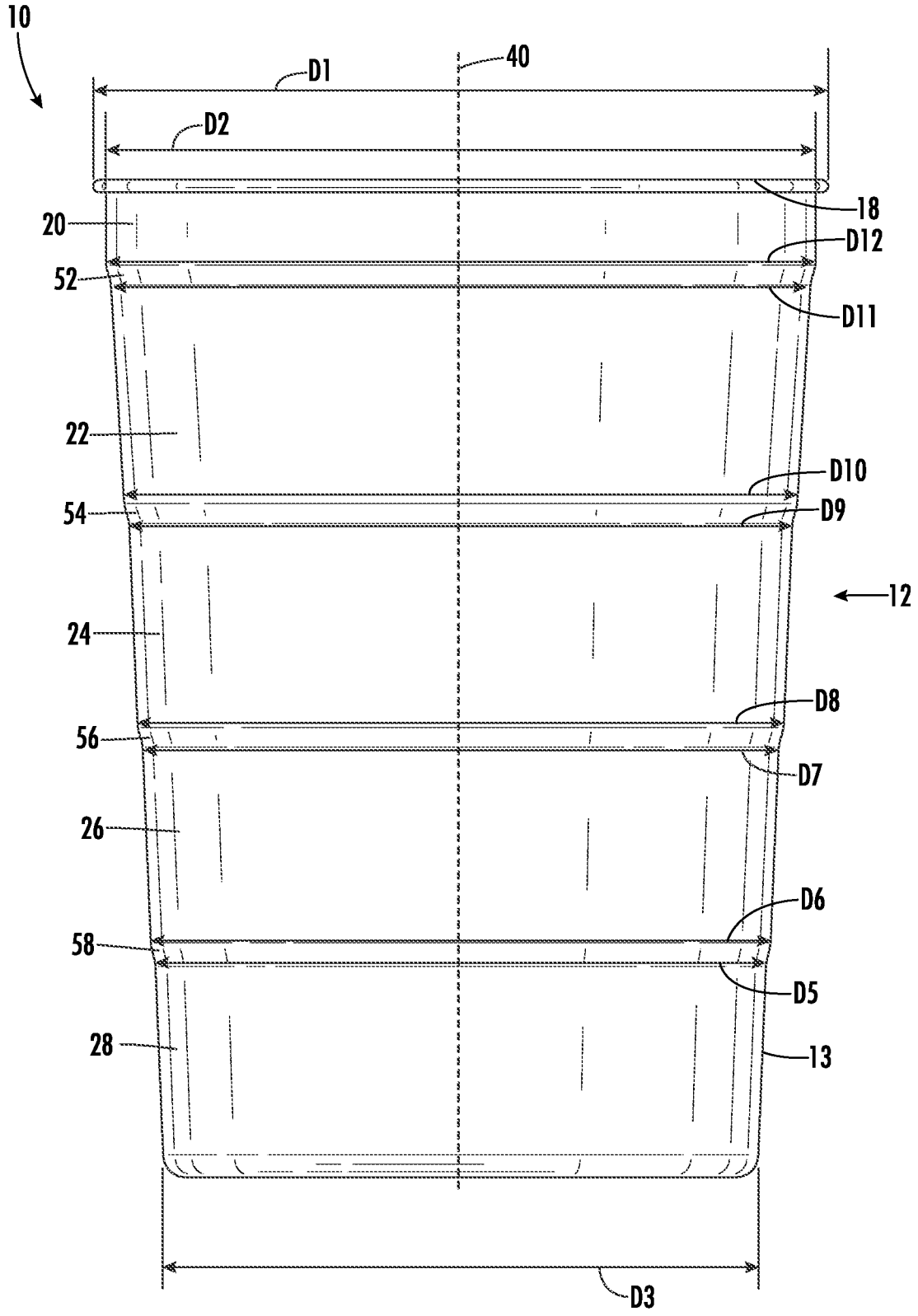
FIG. 4 is a rear view of the thin-walled metal cup of FIG. 1, according to an exemplary embodiment.

Referring to FIGS. 3 and 4, the plurality of sections of cylindrical wall 12 are connected by a plurality of transition surfaces. Such curved sections may be smooth continuous curved sections. A first transition section 52 connects first portion 20 and second portion 22. A second transition section 54 connects second portion 22 and third portion 24. A third transition section 56 connects third portion 24 and fourth portion 26. A fourth transition section 58 connects fourth portion 26 and fifth portion 28. In another embodiment, the thin-walled cup could include a body with a different number of sections and transition surfaces (e.g., 4 sections and 3 transition surfaces, 6 sections and 5 transition surfaces etc.).

At top end 14 of cylindrical wall 12, a first diameter shown as D1 is defined between outside edges of lip 18. In a specific embodiment, D1 is between 3.3 and 3.4 inches and in such embodiments D1 is about 3.325 inches±0.01 inches. Bore 30 and interior surface 32 define a second diameter, shown as D2. In a specific embodiment, D2 is between 85% and 99% of D1, specifically between 90% and 99% of D2 and more specifically between 94% and 96% of D1. In a specific embodiment, D2 is between 3.1 and 3.2 inches and in such embodiments D2 is about 3.187 inches±0.01 inches.

At bottom end 16 of cylindrical wall 12, a third diameter shown as D3. D3 is defined as an outside diameter at fifth portion 28. In a specific embodiment, D3 is between 2.6 and 2.7 inches and in such embodiments D3 is about 2.681 inches±0.01 inches. An inner diameter of fifth portion 28 is defined as D4 (see e.g., FIG. 6). In a specific embodiment D4 is between 85% and 99.9% of D3, specifically between 90% and 99.9% of D3 and more specifically between 97% and 99.9% of D3. In a specific embodiment, D4 is between 2.6 and 2.7 inches and in such an embodiment, D4 is about 2.668 inches±0.01 inches.

At upper boundary 50 of fifth portion 28 a fifth diameter shown as D5 is defined as a inner diameter extending between opposing sides of interior surface 32. In a specific embodiment, D5 is between 2.5 and 2.6 inches and in such embodiments, D5 is about 2.556 inches±0.01 inches. At a lower boundary 49 of fourth portion 26 a sixth diameter shown as D6 is defined as an outer diameter extending between opposing sides of exterior surface 13. In a specific embodiment, D6 is between 2.9 and 3 inches and in such embodiments, D6 is about 2.979 inches±0.01 inches.

At upper boundary 48 of fourth portion 26 a seventh diameter shown as D7 is defined as an inner diameter extending between opposing sides of interior surface 32. In a specific embodiment, D7 is between 2.6 and 2.7 inches and in such embodiments D7 is about 2.676 inches±0.01 inches. At a lower boundary 47 of third portion 24 an eighth diameter shown as D8 is defined as an outer diameter extending between opposing sides of exterior surface 13. In a specific embodiment, D8 is between 3 and 3.1 inches and in such embodiments, D8 is about 3.093 inches±0.01 inches.

At upper boundary 46 of third portion 24 a ninth diameter shown as D9 is defined as an inner diameter extending between opposing sides of interior surface 32. In a specific embodiment, D9 is between 2.7 and 2.8 inches and in such embodiments, D9 is about 2.797 inches±0.01 inches. At a lower boundary 43 of second portion 22 a tenth diameter shown as D10 is defined as an outer diameter extending between opposing sides of exterior surface 13. In a specific embodiment, D10 is between 3.2 and 3.3 inches and in such embodiments D10 is about 3.215 inches±0.01 inches.

At upper boundary 44 of second portion 22 an eleventh diameter shown as D11 is defined as an inner diameter extending between opposing sides of interior surface 32. In a specific embodiment, D11 is between 2.9 and 3 inches and in such embodiments, D11 is about 2.962 inches±0.01 inches. At lower boundary 42 of first portion 20 a twelfth diameter, shown as D12 is defined as an outer diameter extending between opposing sides of exterior surface 13. In a specific embodiment, D12 is between 3.3 and 3.4 inches and in such embodiments, D12 is about 3.379 inches±0.01 inches.

Figure 5:
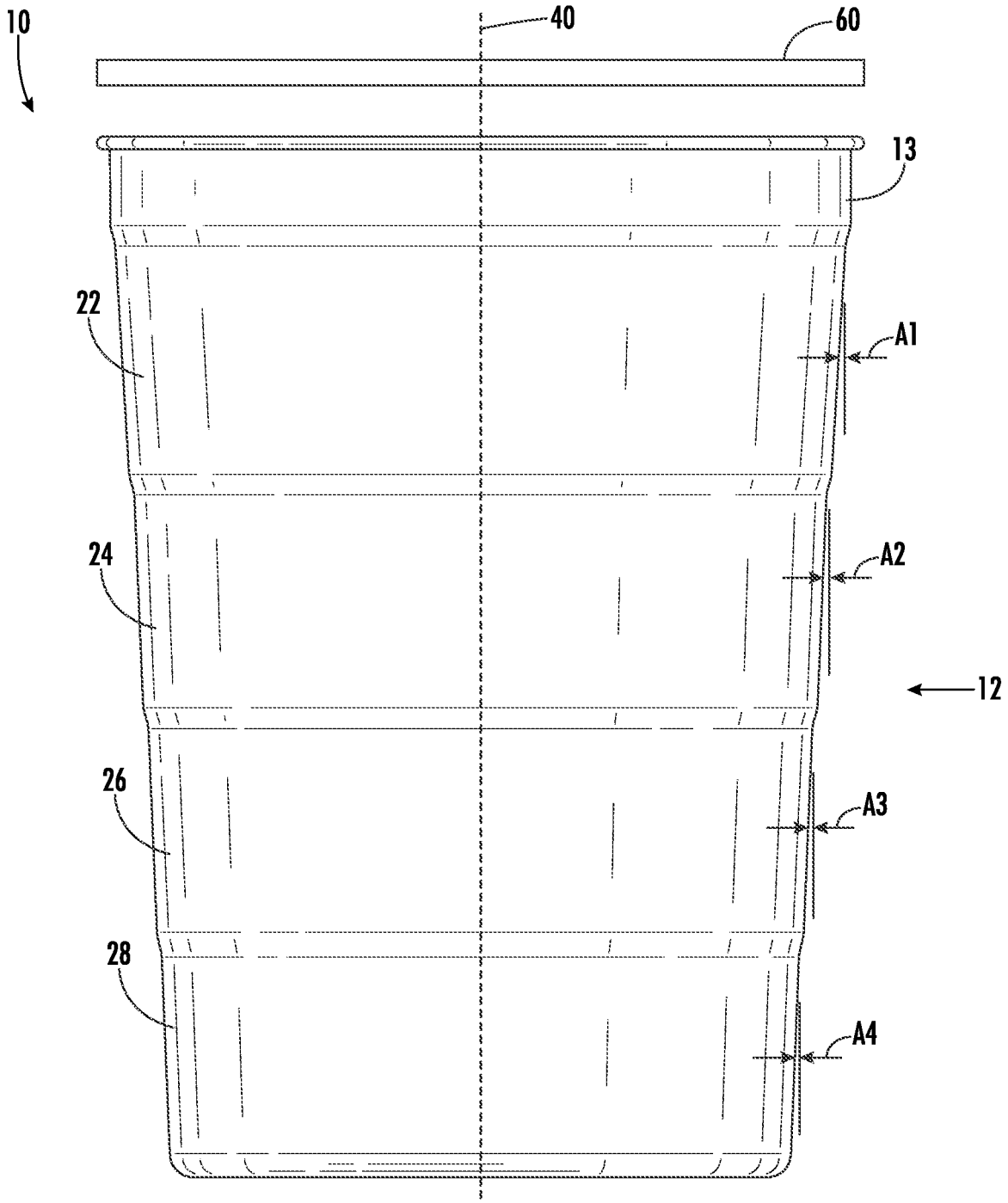
FIG. 5 is a right or left side view the thin-walled metal cup of FIG. 1, according to an exemplary embodiment.

Referring to FIG. 5, a lid or cover 60 shown schematically is couplable with thin-walled metal cup 10. Thin-walled metal cup may be compatible with various types of lids or covers (e.g., heat sealed foil covers, and plastic, steel or aluminum snap on covers).

In a specific embodiment, the plurality of sections of cylindrical wall 12 may have varying angles relative to a reference parallel to longitudinal axis 40. A first angle, shown as A1 is defined as the angle between the wall of second section 22 and longitudinal axis 40. In a specific embodiment A1 is between 1 and 10 degrees, more specifically between 2 and 4 degrees and in such an embodiment A1 is about 3 degrees±0.5 degrees. A second angle shown as A2 is defined between the wall of third section 24 and longitudinal axis 40. In such an embodiment A2 is between 1 and 10 degrees, more specifically between 1 and 3 degrees and in such an embodiment A2 is about 2 degrees±0.5 degrees. A third angle shown as A3 is defined between the wall of fourth section 26 and longitudinal axis 40. In such an embodiment A3 is between 1 and 10 degrees, more specifically between 1 and 3 degrees and in such an embodiment A3 is about 2 degrees±0.5 degrees. A fourth angle shown as A4 is defined between the wall of fifth section 28 and longitudinal axis 40. In such an embodiment A4 is between 1 and 10 degrees, more specifically between 1 and 3 degrees and in such an embodiment A4 is about 2 degrees±0.5 degrees.

Figure 6:
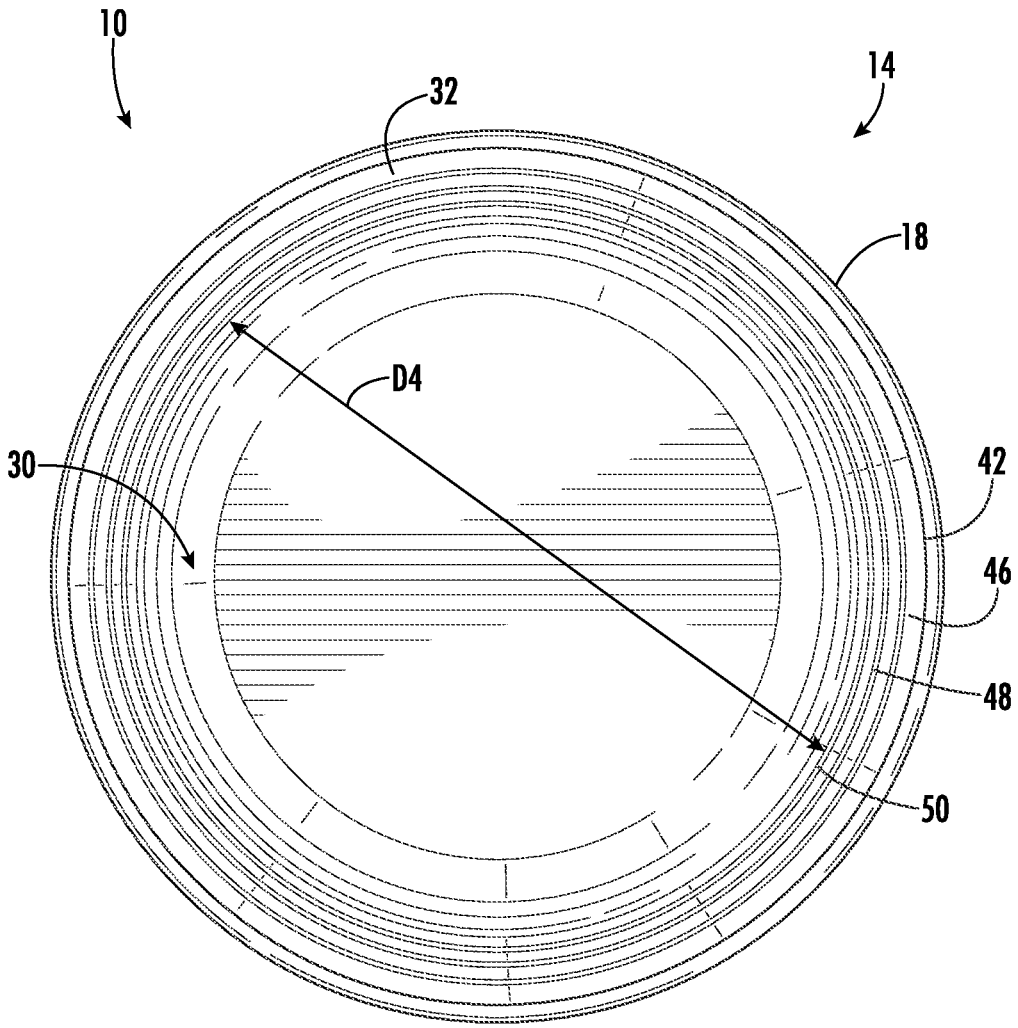
FIG. 6 is a top side view the thin-walled metal cup of FIG. 1, according to an exemplary embodiment.
Figure 7:
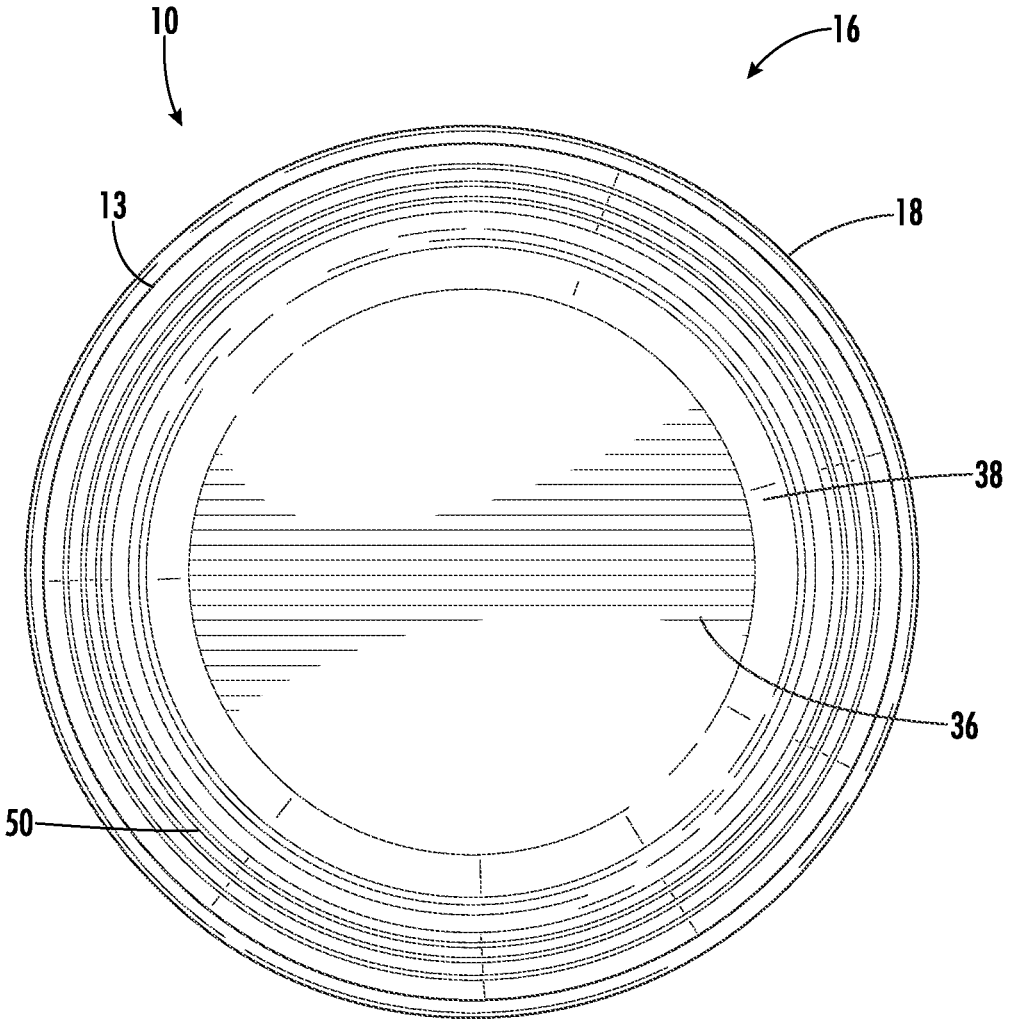
FIG. 7 is a bottom side view the thin-walled metal cup of FIG. 1, according to an exemplary embodiment.

Referring to FIGS. 6-7, a top side view and bottom side view of thin-walled metal cup 10 are shown. The difference in the diameters of the plurality of sections and exterior bottom surface 36 is shown.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

According to exemplary embodiments, the containers, and specifically the container sidewalls, discussed herein are formed from metal, and specifically may be formed from, stainless steel, tin-coated steel, aluminum, etc. In some embodiments, the containers discussed herein are formed from aluminum and the container ends are formed from tin-coated steel. In some embodiments, the sidewall of the container is formed from a metal material and other metals or materials (e.g., polymers, high-temperature plastic, thermoplastics, cardboard, ceramic, etc.) are used to form the end walls of the container.

Containers discussed herein may include containers of any style, shape, size, etc. For example, the containers discussed herein may be shaped such that cross-sections taken perpendicular to the longitudinal axis of the container are generally circular. However, in other embodiments the sidewall of the containers discussed herein may be shaped in a variety of ways (e.g., having other non-polygonal cross-sections, as a rectangular prism, a polygonal prism, any number of irregular shapes, etc.) as may be desirable for different applications or aesthetic reasons. In various embodiments, the sidewall of thin-walled cup 10 may include one or more axially extending sidewall sections that are curved radially inwardly or outwardly such that the diameter of the container is different at different places along the axial length of the container, and such curved sections may be smooth continuous curved sections. In one embodiment, the container may be hourglass shaped. Thin-walled cup 10 may be of various sizes (e.g., 3 oz., 8 oz., 12 oz., 15 oz., 28 oz, etc.) as desired for a particular application.

Further, a container may include a container end (e.g., a closure, lid, cap, cover, top, end, can end, sanitary end, "pop-top", "pull top", convenience end, convenience lid, pull-off end, easy open end, "EZO" end, etc.). The container end may be any element that allows the container to be sealed such that the container is capable of maintaining a hermetic seal. In an exemplary embodiment, the upper container end may be an "EZO" convenience end, sold under the trademark "Quick Top" by Silgan Containers Corp.

In various embodiments, the upper container end may be a closure or lid attached to the body sidewall mechanically (e.g., snap on/off closures, twist on/off closures, tamper-proof closures, snap on/twist off closures, etc.). In another embodiment, the upper ccontainer end may be coupled to the container body via the pressure differential. The container end may be made of metals, such as steel or aluminum, metal foil, plastics, composites, or combinations of these materials. In various embodiments, the container ends, double seams, and sidewall of the container are adapted to maintain a hermetic seal after the container is filled and sealed.

According to various exemplary embodiments, the inner surfaces of the upper and lower container ends and the sidewall may include a liner (e.g., an insert, coating, lining, a protective coating, sealant, etc.). The protective coating acts to protect the material of the container from degradation that may be caused by the contents of the container. In an exemplary embodiment, the protective coating may be a coating that may be applied via spraying or any other suitable method. Different coatings may be provided for different food applications. For example, the liner or coating may be selected to protect the material of the container from acidic contents (see e.g., 31 in FIG.1), such as carbonated beverages, tomatoes, tomato pastes/sauces, etc. The coating material may be a vinyl, polyester, epoxy, EVOH and/or other suitable lining material or spray. The interior surfaces of the container ends may also be coated with a protective coating as described above.

What is claimed is:

1. A thin-walled metal container comprising:
- a thin-walled metal cup comprising:
  - a first end of the cup;
  - a second end of the cup opposing the first end of the cup;
  - a circular lip extending between an outside edge and an inside edge centered on a longitudinal, central axis, the outside edge of the circular lip defining a first diameter;
  - a cylindrical wall extending between the first end and second end of the cup and centered on the longitudinal, central axis, the cylindrical wall comprising:
    - an exterior surface;
    - an interior surface, the interior surface defining a second diameter at the first end of the cup; and
    - a plurality of sections extending between the first end and the second end of the cup, the plurality of sections connected by a plurality of curved transition portions; and
  - a bottom including a circular surface generally parallel to the circular lip and centered on the longitudinal, central axis, the circular surface connecting to a trough at an outside edge of the circular surface;
- wherein the cup includes a height defined between a top of the circular lip and a lower edge of the trough; and
- wherein the first diameter is between 90% and 99% of the second diameter.

2. The thin-walled metal container of claim 1, further comprising a cover couplable to the circular lip, the cover configured to form a tight seal and configured to seal contents stored within the thin-walled metal container.

3. The thin-walled metal container of claim 1, wherein the first diameter is between 3.3 and 3.4 inches.

4. The thin-walled metal container of claim 1, wherein the second diameter is between 3.1 and 3.2 inches.

5. The thin-walled metal container of claim 1, wherein the exterior surface defines a third diameter at the second end of the cup and wherein the interior surface defines a fourth diameter at the second end of the cup.

6. The thin-walled metal container of claim 5, wherein the fourth diameter is between 90% and 99.9% of the third diameter.

7. The thin-walled metal container of claim 5, wherein the third diameter is between 2.6 and 2.7 inches.

8. The thin-walled metal container of claim 1, further comprising a thickness, wherein the thickness is defined between the exterior surface and interior surface at the first end of the cup below the circular lip.

9. The thin-walled metal container of claim 8, wherein the thickness is between .1% and 5% of the height.

10. The thin-walled metal container of claim 8, wherein the thickness is between .02 and .03 inches.

11. A thin-walled metal container comprising:
- a thin-walled metal cup comprising:
  - an open end of the cup including a bore;
  - a closed end of the cup opposing the open end of the cup;
  - a lip extending between an outside edge and an inside edge centered on a longitudinal, central axis, the outside edge of the lip defining a first diameter;
  - a cylindrical wall extending between the open end and closed end of the cup and centered on the longitudinal, central axis, the cylindrical wall comprising:
    - an exterior surface;
    - an interior surface; and
    - a plurality of sections extending between the open end and the closed end of the cup, the plurality of sections connected by a plurality of curved transition portions; and a bottom including a circular surface generally parallel to the lip and centered on the longitudinal, central axis, the circular surface connecting to a trough at an outside edge of the circular surface;

wherein the bore defines a second diameter at the open end of the cup;

wherein the first diameter is between 3.3 and 3.4 inches; and wherein the cup includes a height defined between a top of the lip and a lower edge of the trough.

12. The thin-walled metal container of claim 11, further comprising a cover couplable to the lip, the cover configured to form a tight seal and configured to seal contents stored within the thin-walled metal cup.

13. The thin-walled metal container of claim 11, wherein the cylindrical wall includes five sections and wherein the cylindrical wall includes four curved transition portions positioned between the five sections of the cylindrical wall.

14. The thin-walled metal container of claim 13, wherein a first section of the cylindrical wall extends downward from the lip and a second section of the cylindrical wall positioned between the first section and a third section of the cylindrical wall, wherein the second section of the cylindrical wall extends toward the longitudinal, central axis at a first angle.

* * * * *